US012145017B2

(12) United States Patent
Bikko

(10) Patent No.: US 12,145,017 B2
(45) Date of Patent: Nov. 19, 2024

(54) METHODS, SYSTEMS, AND APPARATUSES FOR RECIPROCAL MUSCLE ACTIVATION AND RELEASE

(71) Applicant: BreathCore, Inc., Orinda, CA (US)

(72) Inventor: Nirinjan Bikko, Orinda, CA (US)

(73) Assignee: BreathCore, Inc., Orinda, CA (US)

( * ) Notice: Subject to any disclaimer, the term of this patent is extended or adjusted under 35 U.S.C. 154(b) by 122 days.

(21) Appl. No.: 18/075,404

(22) Filed: Dec. 5, 2022

(65) Prior Publication Data

US 2023/0173320 A1 Jun. 8, 2023

Related U.S. Application Data

(60) Provisional application No. 63/285,895, filed on Dec. 3, 2021.

(51) Int. Cl.

| | |
|---|---|
| ***A63B 21/02*** | (2006.01) |
| ***A63B 21/05*** | (2006.01) |
| ***A63B 21/055*** | (2006.01) |
| ***A63B 23/035*** | (2006.01) |
| ***A63B 23/12*** | (2006.01) |

(52) U.S. Cl.

CPC ..... *A63B 21/022* (2015.10); *A63B 21/023* (2013.01); *A63B 21/05* (2013.01); *A63B 21/055* (2013.01); *A63B 23/03533* (2013.01); *A63B 23/12* (2013.01)

(58) Field of Classification Search

CPC ..... A63B 21/022; A63B 21/023; A63B 21/05; A63B 21/055; A63B 23/03533; A63B 23/12; A63B 21/0552; A63B 21/154; A63B 21/0004; A63B 21/0428; A63B 21/4045; A63B 23/1209; A63B 21/4035

See application file for complete search history.

(56) References Cited

U.S. PATENT DOCUMENTS

| | | | | |
|---|---|---|---|---|
| 3,132,861 | A * | 5/1964 | Horney | A63B 21/0004 482/46 |
| 3,268,225 | A * | 8/1966 | Kolbel | A63B 21/00043 482/126 |
| 3,330,558 | A * | 7/1967 | Simons, Jr. | A63B 23/14 482/46 |
| 3,717,338 | A * | 2/1973 | Hughes | A63B 23/14 482/46 |
| 4,111,417 | A * | 9/1978 | Gardner | A63B 23/03533 482/130 |

(Continued)

*Primary Examiner* — Andrew S Lo

(74) *Attorney, Agent, or Firm* — Mendelsohn Dunleavy, P.C.; Steve Mendelsohn

(57) ABSTRACT

In various embodiments, an apparatus for exercising can include a housing, a first inner tube, a second inner tube, and a compression spring operable to resist motion when compressed. The first inner tube is coupled with a first end of the compression spring and the second inner tube is coupled with a second end of the compression spring. In addition, the apparatus can also include an extension spring inside the housing. Furthermore, a portion of the compression spring and a portion of each of the first and second inner tubes are inside the housing. Note that a first end of the extension spring is coupled with a first handle or loop and the second end of the extension spring is coupled with a second handle or loop. The extension spring is operable to provide resistance during pulling motion away from center of the apparatus.

9 Claims, 8 Drawing Sheets

(56) References Cited

U.S. PATENT DOCUMENTS 4,211,404 A * 7/1980 Blowsky ..... A63B 21/00043 482/128
4,211,405 A * 7/1980 Blowsky ..... A63B 21/05 482/128
4,376,533 A * 3/1983 Kolbel ..... A63B 23/03525 482/125
4,651,985 A * 3/1987 Salisbury ..... A63B 21/00043 482/122
4,695,049 A * 9/1987 Ciemiega ..... A63B 23/14 482/46
4,856,776 A * 8/1989 Ching-Liang ..... A63B 21/045 482/122
5,046,726 A * 9/1991 Van Straaten ..... A63B 21/05 482/125
5,046,727 A * 9/1991 Wilkinson ..... A63B 21/015 428/909
5,154,685 A * 10/1992 Chen ..... A63B 21/00043 482/121
6,926,747 B2 * 8/2005 Udwin ..... A63B 23/12 482/121
7,175,575 B1 * 2/2007 Dantolen ..... A63B 21/05 482/121
8,777,821 B2 * 7/2014 Lando ..... A63B 23/1245 482/121
10,039,950 B2 * 8/2018 Hao ..... A63B 22/20
10,220,237 B2 * 3/2019 Bentley ..... A63B 21/4035
10,695,604 B2 * 6/2020 Porterfield ..... A63B 21/4049
2002/0198081 A1 * 12/2002 Chen ..... A63B 21/00185 482/23
2004/0152571 A1 * 8/2004 Udwin ..... A63B 21/023 482/126
2009/0093349 A1 * 4/2009 Cooper ..... A63B 21/0004 482/106
2012/0077648 A1 * 3/2012 Farrow ..... A63B 21/4035 482/110
2013/0029811 A1 * 1/2013 Lando ..... A63B 21/05 482/121
2014/0162848 A1 * 6/2014 Fuller ..... A63B 22/20 482/72
2019/0015696 A1 * 1/2019 Porterfield ..... A63B 21/4049

* cited by examiner

METHODS, SYSTEMS, AND APPARATUSES FOR RECIPROCAL MUSCLE ACTIVATION AND RELEASE

CROSS-REFERENCE TO RELATED APPLICATION

This application claims the benefit of U.S. Provisional Patent Application No. 63/285,895 filed on Dec. 3, 2021 entitled "METHOD, SYSTEMS AND APPARATUS FOR RECIPROCAL MUSCLE ACTIVATION AND RELEASE," by Nirinjan Bikko YEE, which is hereby incorporated by reference.

BACKGROUND

Pushing and pulling are functional movements of the human body that use reciprocal muscle activation and release. Reciprocal means opposing or inversely related. Reciprocal muscles of the human body refer to antagonists and stabilizers of an agonist or prime mover muscle or muscle group. Developing coordination, elasticity and tone of reciprocal muscle groups during pulling and pushing supports efficient and healthy movements of the human body that are used in activities of everyday living, breathing, rehabilitation, and performance.

While many kinds of methods, systems and apparatus exist for muscle activation and release, such as free weights, weight training equipment, spring-based equipment, tension bands, gravity-based equipment, there is no single method, system and apparatus that can address activating and releasing opposing muscle(s) through pulling and pushing with resistance in the same movement plane without changing the body position in relationship to the equipment or the equipment itself. By changing the body position or the exercise equipment in between pulling and pushing, stored elastic energy dissipates resulting in less coordination, muscle tone, elasticity in the case of conventional exercise equipment.

SUMMARY

Various embodiments in accordance with the present disclosure can address any disadvantages described above. Note that various embodiments in accordance with the present disclosure generally relate to, but are not limited to, the field of exercise equipment.

It is noted that the present disclosure in various embodiments provides methods, systems, and apparatuses that can address reciprocal muscle activation for one or more people through pulling and pushing with resistance in the same (or substantially similar) movement plane continuously without changing the body position in relationship to the equipment or the equipment itself, thereby utilizing stored elastic energy to create more coordination, muscle tone, and elasticity.

In various embodiments, an apparatus for exercising can include a housing, a first inner tube, a second inner tube, and a compression spring operable to resist motion when compressed. Note that the first inner tube is coupled with a first end of the compression spring and the second inner tube is coupled with a second end of the compression spring. In addition, note that the apparatus can also include an extension spring inside the housing. Furthermore, a portion of the compression spring and a portion of each of the first and second inner tubes are inside the housing. It is noted that a first end of the extension spring is coupled with a first handle or loop and the second end of the extension spring is coupled with a second handle or loop. The extension spring is operable to provide resistance during pulling motion away from center of the apparatus.

In various embodiments, the compression spring of the previous paragraph is operable to provide resistance during pushing motion toward center of the apparatus.

In various embodiments, the extension spring in the second above paragraph is operable to provide recoil toward the center of the apparatus after release of the pulling motion.

In various embodiments, the compression spring of the previous paragraph is operable to provide recoil away from the center of the apparatus after release of the pushing motion.

In various embodiments, the apparatus in the fourth above paragraph comprises two different kinds of resistance to both pulling and pushing motions of a human body in a substantially similar movement plane.

In various embodiments, the apparatus in the fifth above paragraph is portable.

In various embodiments, the compression spring in the sixth above paragraph is operable to be replaced with a second compression spring.

In various embodiments, the extension spring in the seventh above paragraph is operable to be replaced with a second extension spring.

In various embodiments, an apparatus for exercising comprising a housing divided by a median, wherein each side of a median comprises an inner cylinder. The apparatus also comprising a first compression spring operable to resist motion when compressed, wherein a first inner cylinder is coupled with a first end of the first compression spring and the second end of the first compression spring is coupled with the median. The apparatus also comprising a second compression spring operable to resist motion when compressed, wherein a second inner cylinder is coupled with a first end of the second compression spring and the second end of the second compression spring is coupled with the median. The apparatus also comprising a first extension spring inside the first inner cylinder that is coupled with the medial side of the first inner cylinder. The apparatus also comprising a first handle coupled with the lateral side of the first extension spring operable to provide resistance during pulling motion. The apparatus also comprising a second extension spring inside the second inner cylinder that is coupled with the medial side of the second inner cylinder. The apparatus also comprising a second handle coupled with the lateral side of the second extension spring operable to provide resistance during pulling motion.

In various embodiments, the first compression spring in the previous paragraph is operable to provide resistance during pushing motion toward center of the apparatus.

In various embodiments, the first extension spring in the second above paragraph is operable to provide recoil toward the center of the apparatus after release of the pulling motion.

In various embodiments, the first compression spring in the third above paragraph is operable to provide recoil away from the center of the apparatus after release of the pushing motion.

In various embodiments, the apparatus in the fourth above paragraph comprises two different kinds of resistance to both pulling and pushing motions of a human body in a substantially similar movement plane.

In various embodiments, the apparatus in the fifth above paragraph is operable to be separated into a first and second sub-apparatuses at the median.

In various embodiments, the apparatus in the sixth above paragraph is portable.

In various embodiments, an apparatus for exercising comprising a housing and a single spring. The single spring comprising: a middle portion operable to provide resistance during pushing motion toward center of the apparatus: a first end portion; and a second end portion. Note that each of the first and second end portions of the single spring is operable to provide resistance during pulling motion away from center of the apparatus. It is noted that the apparatus further comprising: a first handle coupled with the first end portion of the single spring; and a second handle coupled with the second end portion of the single spring. Note that at least a part of the single spring is located within the housing.

In various embodiments, the apparatus in the previous paragraph comprises two different kinds of resistance to both pulling and pushing motions of a human body in a substantially similar movement plane.

In various embodiments, the apparatus in the second above paragraph is portable.

In various embodiments, the first end portion of the single spring in the third above paragraph is operable to provide recoil toward the center of the apparatus after release of a pulling motion.

In various embodiments, the middle portion of the single spring in the fourth above paragraph is operable to provide recoil away from the center of the apparatus after release of a pushing motion.

While various embodiments in accordance with the present disclosure have been specifically described within this Summary, it is noted that the claimed subject matter are not limited in any way by these various embodiments.

The following detailed description together with the accompanying drawings will provide a better understanding of the nature and advantages of the various embodiments in accordance with the present disclosure.

BRIEF DESCRIPTION OF THE DRAWINGS

Within the accompanying drawings, various embodiments in accordance with the present disclosure are illustrated by way of example and not by way of limitation. It is noted that like reference numerals denote similar elements throughout the drawings. In addition, elements having the same designation have the same or similar function.

DETAILED DESCRIPTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Pushing and pulling are functional movements of the human body that use opposing (reciprocal) muscles and muscle groups. Coordination and tone of these functional movements of the human body are necessary for activities of everyday life, breathing, rehabilitation, sports, and performance. Unlike exercise machines that work bidirectional muscles of the human body across a joint and use one kind of resistance but apply it to different movements, various embodiments of the present disclosure work opposing muscles and muscle groups of the human body with one kind of resistance to optimize the activation and release of muscles used for pulling motions and another kind of resistance to optimize the activation and release of muscles used for pushing motions in a continuous manner.

There are exercise apparatuses that are made of compressive materials, such as bows, compressive rings or circles, which are good for pushing and compression. While you can pull on compressive material, the resistance is so great that it does not offer enough give or range of motion to adequately engage the activation and release of muscles used for pulling.

By comparison, there are exercise apparatuses that are based on extension springs and stretchy materials, such as Therabands. These apparatus are ideal for activating and releasing muscles used in pulling but do not offer compressive resistance to activate and release muscles used for pushing.

Figure 1:
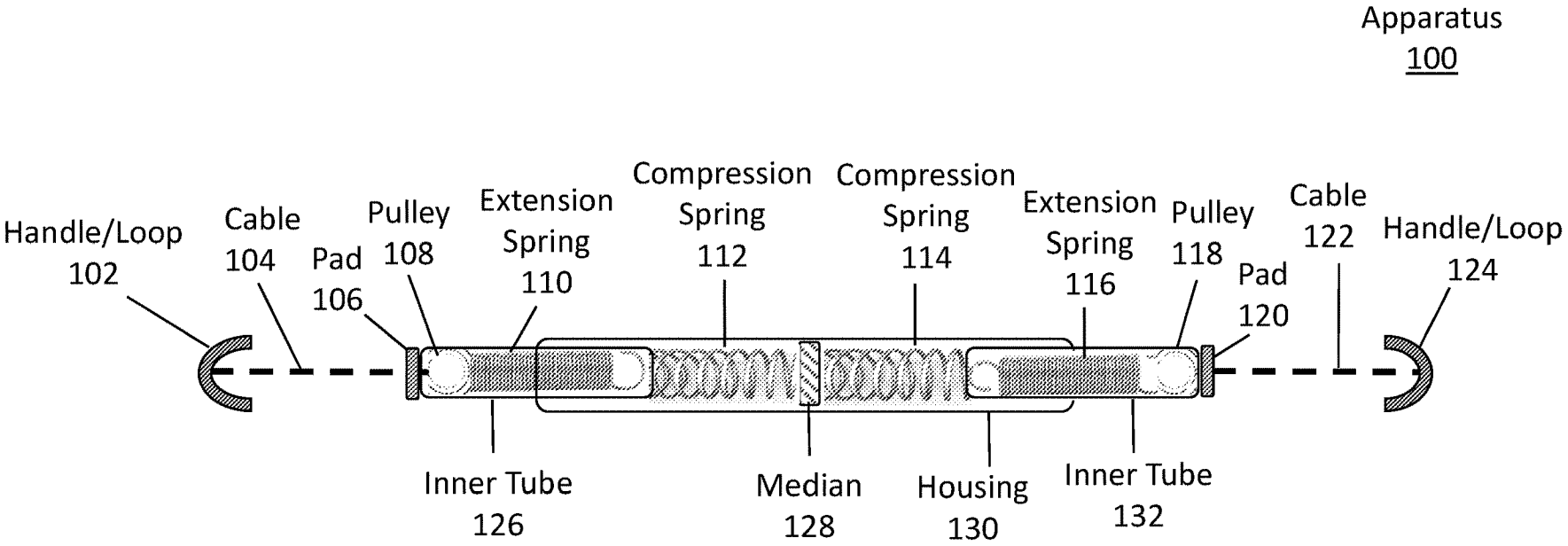
FIG. 1 illustrates an apparatus for reciprocal muscle activation and release in accordance with various embodiments of the present disclosure.

In various embodiment, a single portable apparatus or tool is disclosed that offers two different kinds of resistance to optimize both pulling and pushing motions of the human body in the same (or substantially similar) movement plane. For example, FIG. 1 illustrates an exemplary apparatus 100 for reciprocal muscle activation and release in accordance with various embodiments of the present disclosure. Note that in various embodiments the apparatus 100 can be implemented to include more or less elements than those shows within FIG. 1. In various embodiments, the apparatus 100 can include, but is not limited to, a handle (or loop) 102 coupled with a cable (e.g., stretchy) 104, a pad 106 coupled with an exterior end of an inner tube 126, and the cable 104 coupled with a pulley 108 located inside the inner tube 126. Note that the pulley 108 is attached to an end of an extension (or expansion) spring 110. In addition, the other end of the extension spring 110 is attached to an internal end of the inner tube 126 closest to a compression spring 112. It is noted that one end of the compression spring 110 is attached to the exterior end of the inner tube 126 while the other end of the compression spring 110 is attached to one side of a median 128. Note that the opposite side of the median 128 is attached to one end of a compression spring 114. The other end of the compression spring 114 is attached to an exterior end of an inner tube 132. Inside of the inner tube 132, one end of an extension (or expansion) spring 116 is attached to an interior end of the inner tube 132. The other end of the extension spring 116 is attached to a pulley 118 located inside the inner tube 132. The pulley 118 is attached to a cable (e.g., stretchy) 122, which is attached to a handle (or loop) 124. The pad 120 is coupled with an exterior end of the inner tube 132. Moreover, note that the compression springs 112 and 114, the median 128, at least portions of the extension springs 110 and 116, and at least portions of the inner tubes 126 and 132 are located within a housing 130.

More specifically, in various embodiments, the apparatus 100 can include, but is not limited to, the housing 130 (e.g., cylinder or any other shape) divided inside by the median 128. On one side of the median 128 there is the compression spring 112, the inner cylinder 126, and the extension spring 110. In addition, on the opposite side of the median 128 there is the compression spring 114, the inner cylinder 132, and the extension spring 116. The medial side of each of the inner cylinders 126 and 132 (the side of each of the cylinders situated closer to the median 128 or midline) is attached to the lateral side of each of the compression springs 112 and 114, respectively, (the side of the spring that is away from the median 128 or center). Note that the lateral side of the inner cylinder 126 is terminated with the pad 106 for pushing the inner cylinder 126 against the compression spring 112 inward toward the median 128. Moreover, the lateral side of the inner cylinder 132 is terminated with the pad 120 for pushing the inner cylinder 132 against the compression spring 114 inward toward the median 128. Note that each of the inner cylinders 126 and 132 extends beyond and through the lateral border of the housing cylinder 130 so that there is room for each of the cylinders 126 and 132 to move with pushing and releasing motions.

Furthermore, inside the inner cylinder 126 of FIG. 1 there is the extension spring 110, which is attached to the medial side of the inner tube 126 along with the cable 104, and handle (or loop) 102 to activate and release muscles of a person used in pulling motions away from the median 128 or center of the apparatus 100. The release of the pulling motion by a person releases the extension spring 110 and cable 104 back toward the median 128 and the starting position (e.g., as shown by the release/recoil 204 in FIG. 2). It is noted that inside the inner cylinder 132 there is the extension spring 116, which is attached to the medial side of the inner tube 132 along with the cable 122, and handle (or loop) 124 to activate and release muscles of a person used in pulling motions away from the median 128 or center of the apparatus 100. Note that the release of the pulling motion by the person releases the extension spring 116 and cable 122 back toward the median 128 and the starting position (e.g., as shown by the release/recoil 204 in FIG. 2).

With reference to FIG. 1, it is noted that apparatus 100 can be implemented in a wide variety of ways in accordance with various embodiments of the present disclosure. For example, in various embodiments the apparatus 100 can be implemented without the cables 104 and 122, and pulleys 108 and 118. Without these elements, the handle 102 of the apparatus 100 can be attached to the pad 106 and the lateral end of the extension spring 110. In addition, the handle 124 can be attached to the pad 120 and the lateral end of the extension spring 132.

Furthermore, in various embodiments the apparatus 100 can be implemented without the cables 104 and 122. Without these elements, the handle 102 of the apparatus 100 can be attached to the pad 106 and the pulley 108. In addition, the handle 124 can be attached to the pad 120 and the pulley 118.

Moreover, in various embodiments the apparatus 100 can be implemented without the pulleys 108 and 118. Without these elements, the medial end of the cable 104 can be attached to the lateral end of the extension spring 110. Further, the medial end of the cable 122 can be attached to the lateral end of the extension spring 132.

With reference to FIG. 1, in various embodiments, each of the housing, the inner tubes 126 and 132 can be implemented with, but not limited to, holes, slots, voids, and the like.

Figure 2:
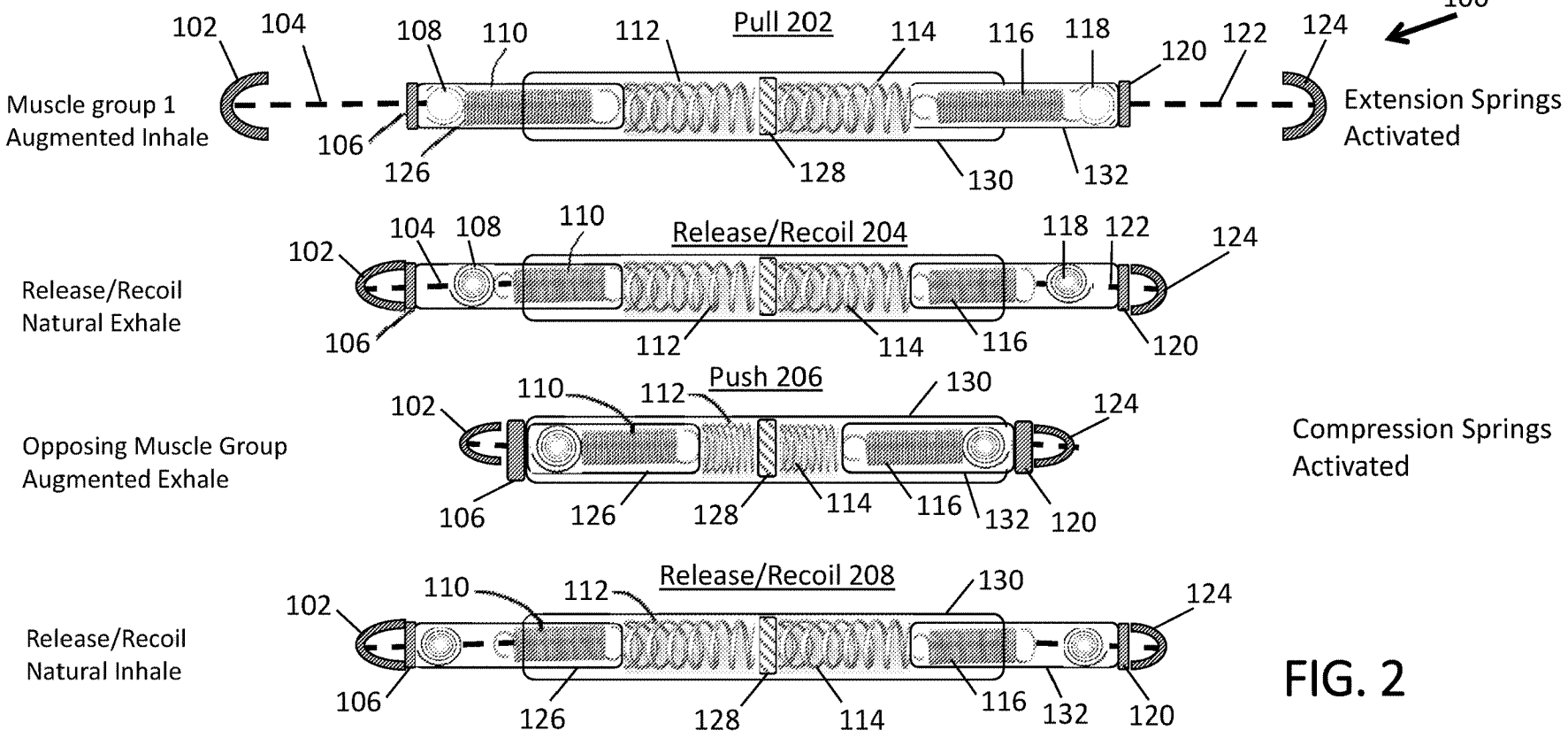
FIG. 2 illustrates the manners in which the apparatus can be used for reciprocal muscle activation and release in accordance with various embodiments of the present disclosure.

FIG. 2 illustrates the manners in which the apparatus 100 shown in FIG. 1 can be used for reciprocal muscle activation and release in accordance with various embodiments of the present disclosure. For example, during a pulling motion 202 by a person using apparatus 100, the person will pull handles 102 and 124 in opposite directions from the median 128 or center of the apparatus 100 and activates the cables 104 and 122, the pulleys 108 and 118, and the extension springs 110 and 116. It is noted that during the pulling motion 202, the cables 104 and 122 along with the extension springs 110 and 116 are stretched or extended as shown. Furthermore, note that the pulling motion 202 can involve a muscle group 1 of the person and also augments the person to inhale. During the release/recoil 204, a person can release the pulling motion on the handles 102 and 124 which releases the extension springs 110 and 116, the pulleys 108 and 118, and the cables 104 and 122 causing them to recoil back toward the median 128 and the starting position (e.g., as shown). It is noted that the release of the pulling motion by the person can advantageously result in a natural exhale.

During the pushing motion 206 of FIG. 2 by a person using the apparatus 100, the person pushes the handles 102 and 124 and the pads 106 and 120, respectively, toward the median 128 or center of the apparatus 100 that results in the movement of the inner tubes 126 and 132 compressing and activating the compression springs 112 and 114, respectively (e.g., as shown). Note that the pushing motion 206 can involve an opposing muscle group of the person and also augments the person to exhale. During the release/recoil 208, the person releases the pushing motion on the handles 102 and 124 which releases the compression springs 112 and 114 causing the inner tubes 126 and 132, the pads 106 and 120, and the handles 102 and 124 to recoil away from the median 128 and back to the starting position (e.g., as shown). Note that the release of the pushing motion 206 by the person can advantageously result in a natural inhale.

Figure 3:
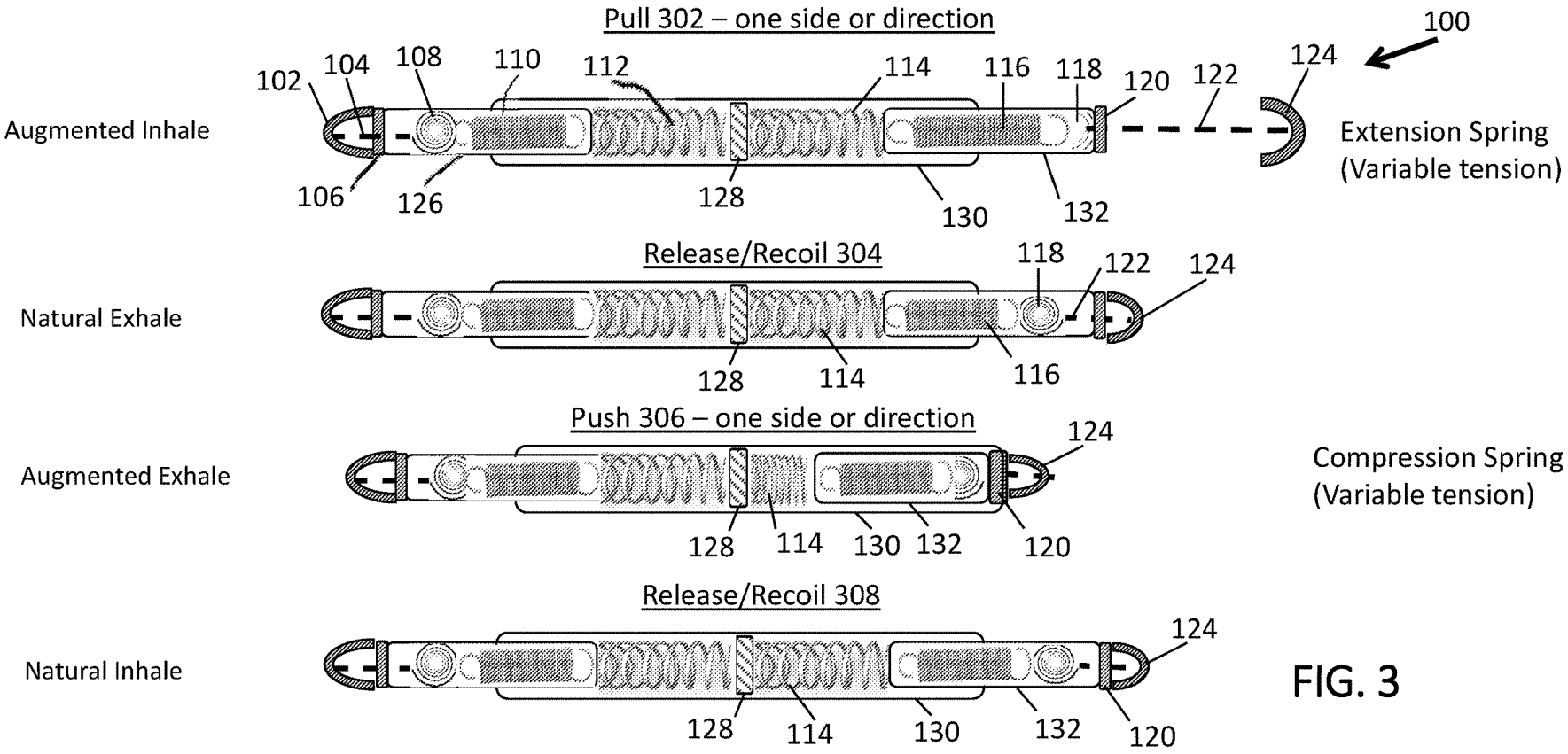
FIG. 3 illustrates the apparatus for reciprocal muscle activation and release where the apparatus is held in a stabilized position on one end in accordance with various embodiments of the present disclosure.

FIG. 3 illustrates the apparatus 100 for reciprocal muscle activation and release where the apparatus 100 is held in a stabilized position on one end in accordance with various embodiments of the present disclosure. In various embodiments, the left and right sides of the apparatus 100 function independently as shown in FIG. 3. Movements can be performed on one side of the body at a time, either pulling or pushing, independently of the other side of the apparatus 100. Accordingly, both sides of the body of a person can either push or pull the apparatus 100 independently of each other.

In various embodiments, during a one side pulling motion 302 by a person using the right side of the median 128 of the apparatus 100, the person will pull handle 124 in a direction away from the median 128 or center of the apparatus 100 and activates the cable 122, the pulley 118, and the extension spring 116. It is noted that during the one side pulling motion 302 of the apparatus 100, the cable 122 along with the extension spring are stretched or extended as shown in FIG. 3 thereby providing variable tension to the person. Note that during the one side pulling motion 302 of the apparatus 100, the left side of the median 128 of the apparatus 100 is held in a stabilized position. Furthermore, note that the one side pulling motion 302 can involve a muscle group of the person and also augments the person to inhale. During the one side release/recoil 304 of the apparatus 100, a person can release the one side pulling motion on the handle 124 which releases the extension spring 116, the pulley 118, and the cable 122 causing them to recoil back toward the median 128 and the starting position (e.g., as shown). Note that the release of the pulling motion by the person can advantageously result in a natural exhale.

During the one side pushing motion 306 of FIG. 3 by a person using the apparatus 100, the person pushes the handle 124 and the pad 120 toward the median 128 or center of the apparatus 100 which results in the movement of the inner tube 132 compressing and activating the compression spring 114 (e.g., as shown) thereby providing variable tension to the person. Note that during the one side pushing motion 306 of the apparatus 100, the left side of the median 128 of the apparatus 100 is held in a stabilized position. Note that the one side pushing motion 306 of the apparatus 100 can involve an opposing muscle group of the person and also augments the person to exhale. During the one side release/recoil 308 of the apparatus 100, the person releases the pushing motion on the handle 124 which releases the compression spring 114 causing the inner tube 132, the pad 120, and the handle 124 to recoil away from the median 128 and back to the starting position (e.g., as shown). Note that the release of the one side pushing motion 306 by the person can advantageously result in a natural inhale.

Figure 4:
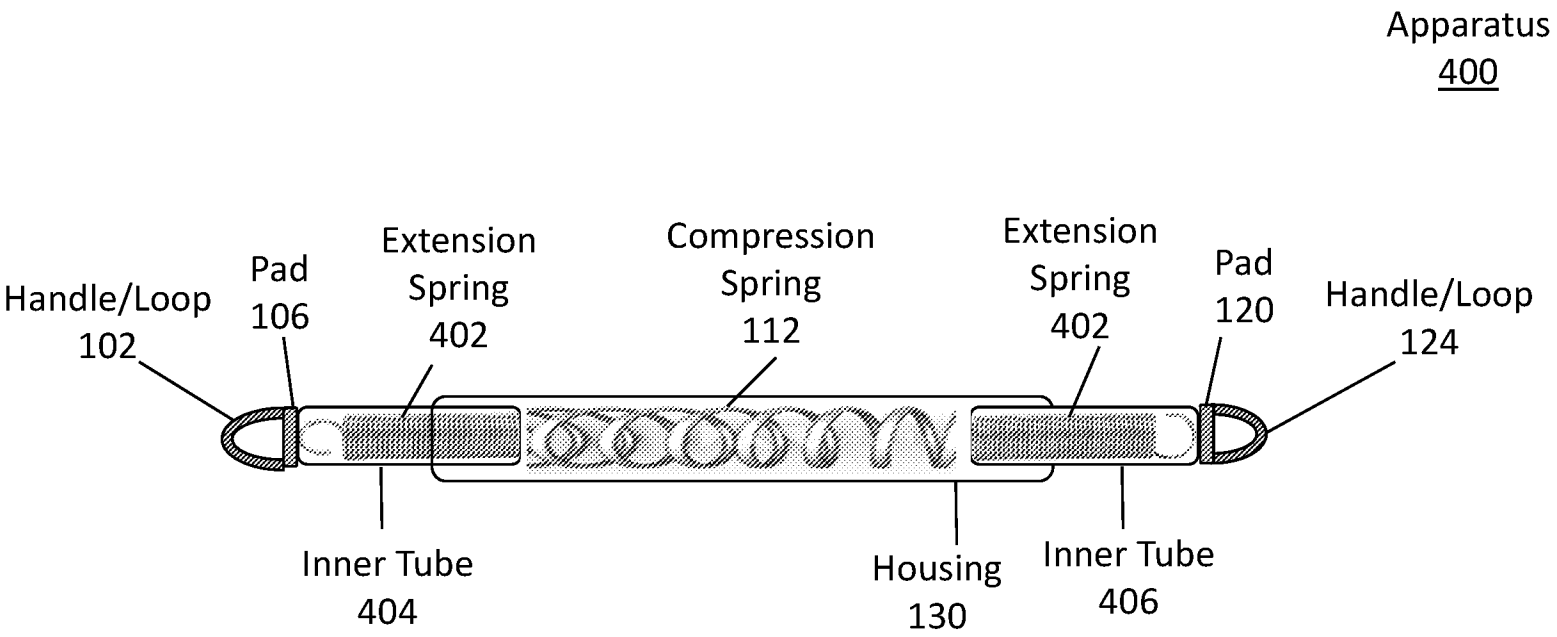
FIG. 4 illustrates another apparatus for reciprocal muscle activation and release in accordance with various embodiments of the present disclosure.

FIG. 4 illustrates an apparatus 400 for reciprocal muscle activation and release in accordance with various embodiments of the present disclosure. In various embodiments, the apparatus 400 can include, but is not limited to, a handle or loop 102, a pad 106, an extension spring 402, an inner tube 404, a compression spring 112, a housing 130, an inner tube 406, a pad 120, and a handle or loop 124. It is noted that the extension spring 402 is located within the interior space or middle of the compression spring 112 and is also located within the inner tubes 404 and 406. Note that the inner tubes 404 and 406 each have a hole on their medial end such that the extension spring 402 can move through those holes. Furthermore, one end of the compression spring 112 can be coupled to the medial end of the inner tube 404 while the other end of the compression spring 112 can be coupled to the medial end of the inner tube 406. Note that one end of the extension spring 402 can be coupled with the pad 106 and handle 102 while the other end of the extension spring 402 can be coupled with the pad 120 and handle 120. Note that the apparatus 400 can be implemented and operate in any manner similar to the implementations and operations of the apparatus 100 described herein and shown within the figures, but is not limited to such. In various embodiments, it is noted that the apparatus 400 can be modified such that instead of the extension spring 402 being located within the interior space of the compression spring 112, the compression spring 112 can located within the interior space of the extension spring 402 in various embodiments.

Figure 5:
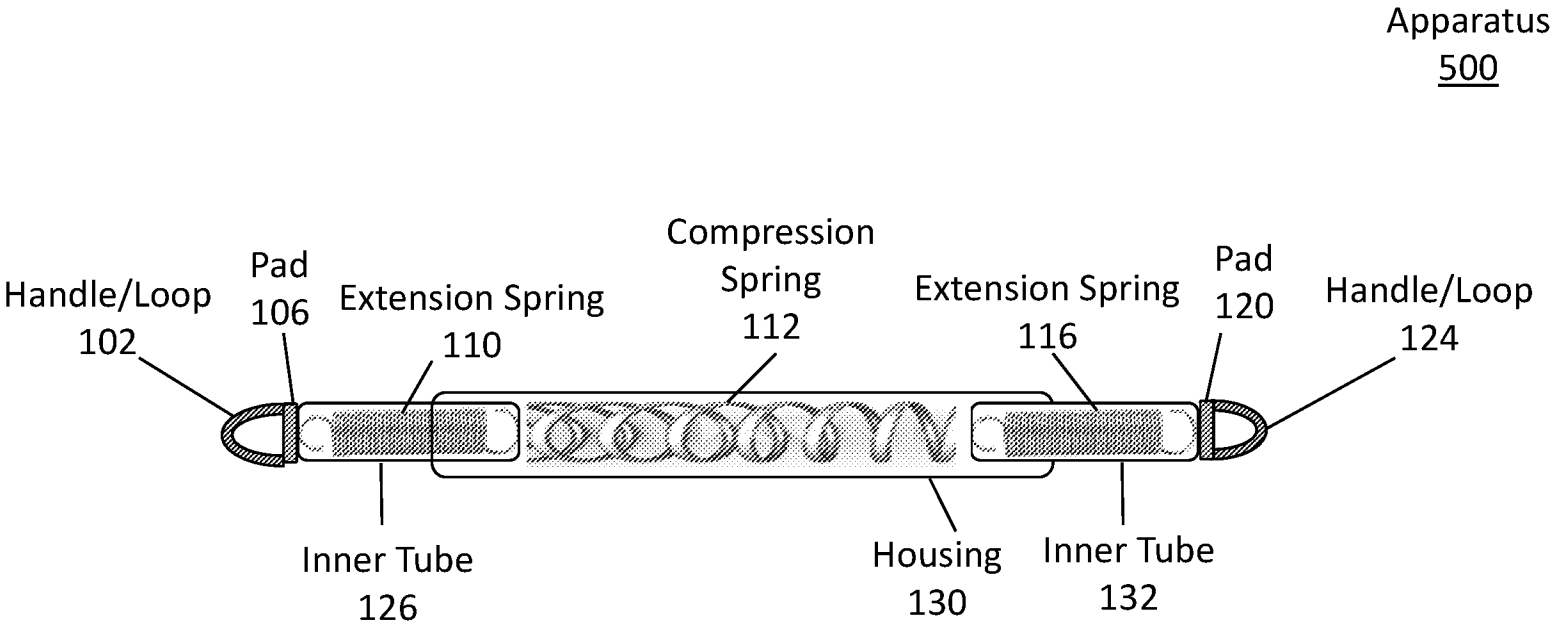
FIG. 5 illustrates yet another apparatus for reciprocal muscle activation and release in accordance with various embodiments of the present disclosure.

FIG. 5 illustrates an apparatus 500 for reciprocal muscle activation and release in accordance with various embodiments of the present disclosure. In various embodiments, it is noted that the apparatus 500 includes many of the same elements or components as apparatus 100 (e.g., FIG. 1). However, one of the main differences between the apparatus 500 and the apparatus 100 is that the apparatus 500 is implemented with a single compression spring 112 and also does not include the median 128. In addition, the apparatus 500 does not include the cable 104, cable 122, pulley 108, and pulley 118. Therefore, within the apparatus 500, an end of the compression spring 112 can be coupled with the medial end of the inner tube 132 and the lateral end of the extension spring 116 can be coupled with the pad 120 and the handle 124. In addition, within the apparatus 500, the lateral end of the extension spring 110 can be coupled with the pad 106 and the handle 102. In various embodiments of the apparatus 500, it is noted that the remaining elements or components of the apparatus 500 may be coupled or attached together as described herein with reference to the apparatus 100, but is not limited to such. Note that the apparatus 500 can be implemented and operate in any manner similar to the implementations and operations of the apparatus 100 described herein and shown within the figures, but is not limited to such.

Figure 6:
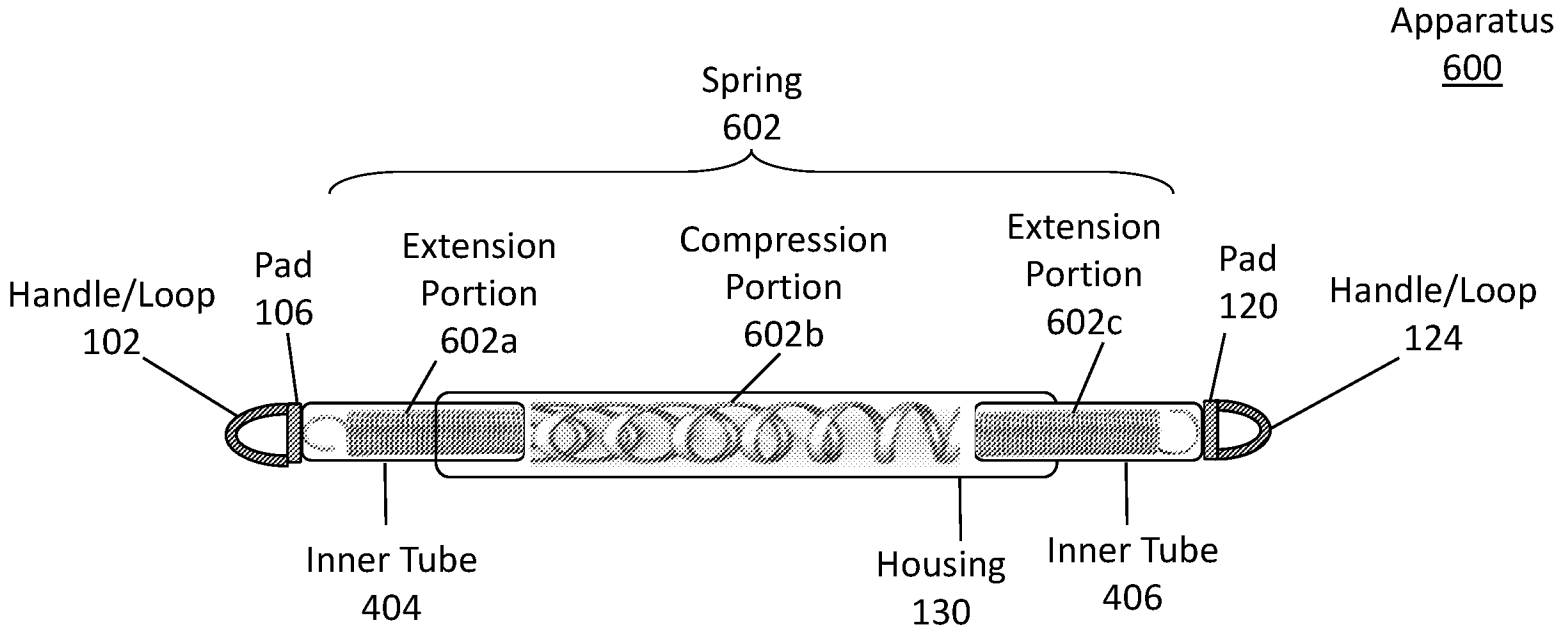
FIG. 6 illustrates yet another apparatus for reciprocal muscle activation and release in accordance with various embodiments of the present disclosure.

FIG. 6 illustrates an apparatus 600 for reciprocal muscle activation and release in accordance with various embodiments of the present disclosure. In various embodiments, it is noted that the apparatus 600 includes many of the same elements or components as apparatus 100 (e.g., FIG. 1). However, one of the main differences between the apparatus 600 and the apparatus 100 is that the apparatus 600 is implemented with a single spring 602 that includes an extension portion 602*a*, a compression portion 602*b*, and an extension portion 602*c*, but is not limited to such. Note that the single spring 602 has the compressive functionality (the compression portion 602*b*) of a compression spring (e.g., 112) and its outer ends have the extension functionality (the extension portions 602*a* and 602*c*) of extension springs (e.g., 110 and 116). In addition, the apparatus 600 also does not include the median 128, the cable 104, cable 122, pulley 108, pulley 118, and inner tubes 126 and 132. Note that the apparatus 600 can be implemented with the inner tubes 404 and 406 (as described with reference to FIG. 4) wherein each inner tube includes a hole or void for the spring 602 to pass through the respective inner tube. Therefore, within the apparatus 600, an end of the extension portion 602*a* of the spring 602 can be coupled with the pad 106 and the handle 102 while an end of the extension portion 602*c* of the spring 602 can be coupled with the pad 120 and the handle 124. In addition, the inner tube 404 can be coupled with a lateral end of the compression portion 602*b* of the spring 602 while the inner tube 406 can be coupled with the other lateral end of the compression portion 602*b* of the spring 602. In various embodiments of the apparatus 600, it is noted that the remaining elements or components of the apparatus 600 may be coupled or attached together as described herein with reference to the apparatus 100, but are not limited to such. Note that the apparatus 600 can be implemented and operate in any manner similar to the implementations and operations of the apparatus 100 described herein and shown within the figures, but is not limited to such.

With reference to the apparatus 600, in various embodiments, it is noted that the spring 602 can be implemented in a wide variety of ways. For example, the spring 602 can be implemented such that portion 602*a* is instead implemented as a compression portion of spring 602, portion 602*b* is instead implemented as an extension portion of spring 602, and portion 602*c* is instead implemented as a compression portion of spring 602, but is not limited to such. Furthermore, the spring 602 can be implemented with more or less portions than those shown in FIG. 6.

Figure 7:
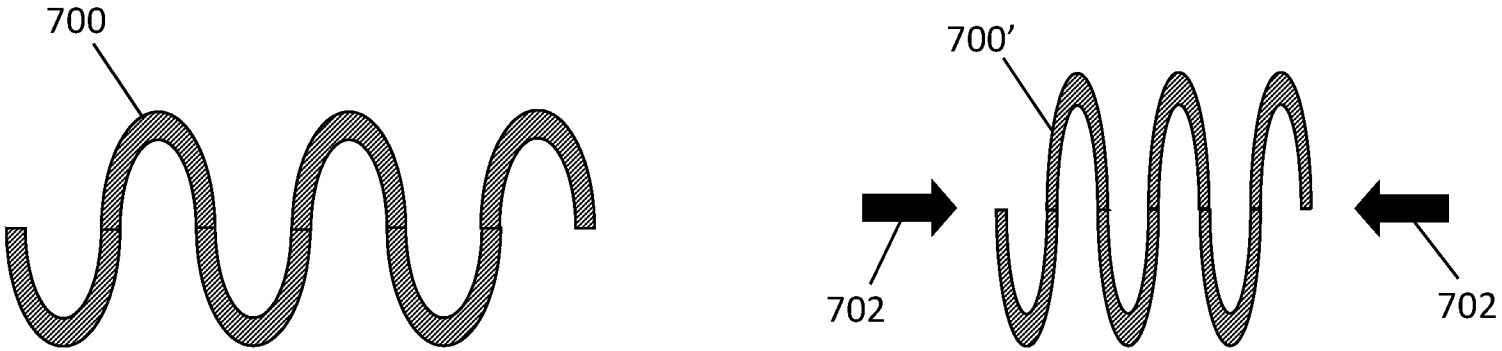
FIG. 7 illustrates an extension band that can be used to replace any extension spring of any of the apparatuses (as may be appropriate) described herein for reciprocal muscle activation and release in accordance with various embodiments of the present disclosure.

FIG. 7 illustrates an extension band 700 that can be used to replace any extension spring of any of the apparatuses (e.g., 100, 400, 500, 600, etc. as may be appropriate) described herein for reciprocal muscle activation and release in accordance with various embodiments of the present disclosure. Note that FIG. 7 is showing a side view of the extension band 700 that has been formed or molded to include a plurality of waves or folds that can cause the extension band 700 to compress in an organized manner. For example, as a compressive force 702 is applied to the extension band 700, note that it becomes a compressed extension band 700' that has compressed in an organized manner and is not distorted or out of line. In addition, once the compressive force 702 is released on the compressed extension band 700', the formed or molded waves or folds will cause the extension band 700 to release or recoil to its original shape or form.

Figure 8:
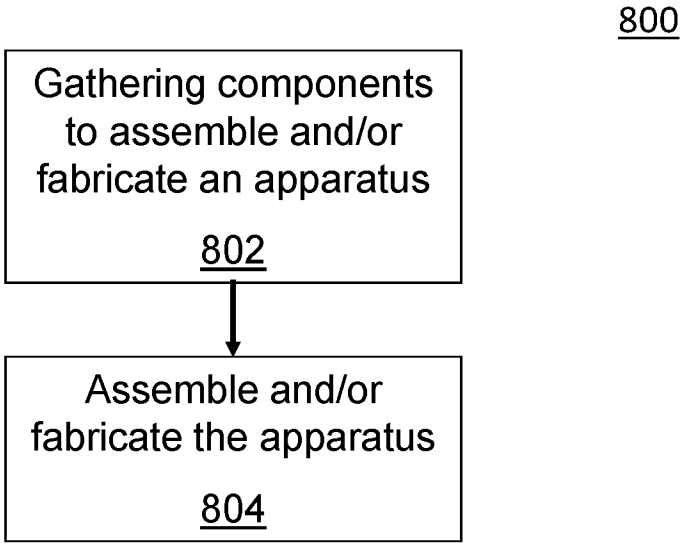
FIG. 8 illustrates a method in accordance with various embodiments of the present disclosure.

FIG. 8 illustrates a method 800 for assembling and/or fabricating an apparatus (e.g., 100, 400, 500, 600, etc.) for reciprocal muscle activation and release in accordance with various embodiments of the present disclosure.

At 802, all the components or elements for assembling and/or fabricating an apparatus (e.g., 100, 400, 500, 600, etc.) for reciprocal muscle activation and release in accordance with various embodiments of the present disclosure can be gathered (or collected), created, and/or produced.

At 804 of FIG. 8, all the components or elements are assembled and/or fabricated to produce the apparatus (e.g., 100, 400, 500, 600, etc.) for reciprocal muscle activation and release in accordance with various embodiments of the present disclosure. Note that method 800 can be implemented with additional operations in accordance with various embodiments.

It is noted that the present disclosure can include a wide variety of embodiments. For example, in various embodiments, an apparatus (e.g., similar to 100, 400, 500, 600, etc. as may be appropriate) can be implemented with, but not limited to, a single compression spring and a single extension spring in the housing cylinder. There are two inner cylinders that are attached, one to the left and one to the right side of the compression spring. There are two cables with pulleys that are attached to the extension spring, one on the left and one on the right, inside the left and right inner cylinders.

In various embodiments, an apparatus (e.g., similar to 100, 400, 500, 600, etc. as may be appropriate) can be implemented with, but is not limited to, a stretchy cable attached to the extension spring, a pulley to provide additional directional pulls a coil spring used as an extension spring, telescoping inner cylinders, that can be locked into place or inserts that screw on the inner cylinders to change the length of the apparatus to fit people of different sizes and different ranges of movement and the ability to unscrew (or disconnect or separate) the apparatus at the median creating two apparatuses (or sub-apparatuses) each with the ability to pull with resistance and push with resistance.

In various embodiments, any of the apparatuses (e.g., 100, 400, 500, 600, etc.) described herein can be implemented with one or more of the following (as may be appropriate): telescoping tubes or inserts with settings that lock into place to adjust the length of the device for different users: enabling different resistance settings for the apparatus, stabilizing the apparatus by a wall attachment or stand: enabling different handles, loops, and pads for the apparatus; and enabling the disassembling of the apparatus into two halves (or sub-apparatuses), each with pulling and pushing resistance.

In various embodiments, some of the advantages of any of the apparatuses (e.g., 100, 400, 500, 600, etc.) described herein is that each can provide variable extension and compressive resistance to its user. In addition, any of the apparatuses (e.g., 100, 400, 500, 600, etc.) described herein can each provide pull and push resistance and without repositioning the body of the user or the apparatus (such that it may be continuous).

In various embodiments, any of the apparatuses (e.g., 100, 400, 500, 600, etc.) described herein can take advantages of the following: note that the utilization of stored elastic energy accumulates when moving (e.g., agonist or prime mover) muscles of a person's body against variable resistance. Once the resistance is released, the stored elastic energy creates a rebound or recoil in the muscle tissues and body walls and then dissipates. By continuing the movement in the opposite direction (e.g., activating the antagonist) with variable resistance, the elastic energy, instead of dissipating, is captured and added to the elastic energy of the new movement and its release/recoil, thereby increasing both power and elasticity of a person's body. In various embodiments, any of the apparatuses (e.g., 100, 400, 500, 600, etc.) described herein can provide these benefit to its user. Furthermore, when applied to the prime, secondary and accessory muscles of breathing, the increased power and elastic energy influences the volume capacity, ventilation, full movement and recoil of the lungs, thereby increasing power and elasticity in the muscles, body walls and lungs.

In various embodiments, note that the uses of any of the apparatuses (e.g., 100, 400, 500, 600, etc.) described herein can each include, but are not limited to: (1) reciprocal muscle training-full body: continuous or separate movements, all three planes of movement; (2) Breathing—building power and elasticity in the muscles needed to take a bigger breath and to reach full lung capacity on inhalation and exhalation: (3) Feet—in between feet—extension and compression laterally: standing poses, sitting, for bunions; and (4) Folding mechanisms: To create more ease in unfolding and folding foldable devices such as walkers and stools.

In various embodiments, note that an apparatus can be implemented with half of any of the apparatuses (e.g., 100, 400, 500, 600, etc.) shown and described herein. For example, an apparatus can be implemented with the median 128 of FIG. 1 and all the components and/or elements located to the right of the median 128, but not limited to such.

In various embodiments, with reference to any of the apparatuses (e.g., 100, 400, 500, 600, etc.) as may be appropriate, the compression and extension springs provide two different types of variable resistance, one for pushing and one for pulling, addressing opposing muscles.

In various embodiments, with reference to any of the apparatuses (e.g., 100, 400, 500, 600, etc.) as may be appropriate, the compression and extension springs enable variable resistance, incrementally increasing the load (resistance) over distance and releasing the load (resistance) incrementally over distance to opposing muscles and muscle groups of a person to maximize and utilize stored elastic energy in the tissues of that person to increase power, elasticity, coordination and tone.

Various embodiments in accordance with the present disclosure (e.g., any of apparatuses 100, 400, 500, 600, etc.), can be used to train (or retrain) the strength, elasticity and coordination of all opposing muscles in the body including all the respiratory muscles that enable a bigger breath and thereby increase the strength and elasticity of the person's lungs.

When using one or more various embodiments of the present disclosure (e.g., any of apparatuses 100, 400, 500, 600, etc.) and applying it to the primary, secondary and accessory muscles of breathing and their opposing muscles, the increased muscle power and stored elastic energy can help people to take deeper inhalations and exhalations, and achieve greater movement of the ribcage, torso, respiratory muscles and lungs. This in turn can increase lung volume capacity, ventilation and lung elasticity (full movement and recoil of the lungs). In various embodiments, applications for this method, system and apparatus can include but are not limited to: being an aid for breathing exercises, physical, pulmonary and neurological rehabilitation, COVID-19 recovery, Yoga, Pilates, fitness, sports, performance and meditation as well as improving breathing in the activities of daily living.

In various embodiments, with reference to any of the apparatuses (e.g., 100, 400, 500, 600, etc.) as may be appropriate, the handle and cable on the apparatus can be pulled engaging the extension spring as the user takes a deeper inhale. The pulling and extension spring is released as the user naturally exhales and the muscles and lungs return to their starting position. The outside of the inner cylinder of the apparatus is pushed through the housing inward engaging the compression spring, as the user takes a deeper exhale. The pushing and compression spring is released as the user naturally and reflexively inhales and the muscles and lungs expand into their starting position. In various embodiments, stored elastic energy from pulling and inhalation is transferred to the reciprocal muscles of pushing and exhalation while stored elastic energy from pushing and exhalation is transferred to the reciprocal muscles of pulling and inhalation, thereby optimizing strength, elasticity and coordination of the respiratory muscles and lungs for all four phases of the breath cycle (e.g., inspiration, inspiratory pause, expiration, and expiratory pause).

Various embodiments in accordance with the present disclosure, with reference to any of the apparatuses (e.g., 100, 400, 500, 600, etc.), can be low cost, light, portable, and easy to use. Various embodiments (e.g., any of the apparatuses 100, 400, 500, 600, etc. described herein) can be used anywhere people need or desire muscular training and coordination of opposing muscle groups, including but not limited to, fitness, sports performance, rehabilitation, physical therapy, and respiratory therapy. The device or apparatus (e.g., any of the apparatuses 100, 400, 500, 600, etc. described herein) in various embodiments can be used by simply holding it and performing pulling and pushing motions. In various embodiments, the device or apparatus (e.g., any of the apparatuses 100, 400, 500, 600, etc. described herein) can also be fastened to a hospital bed, over a door, or any attachment or stand and used accordingly making it ideal for users of all abilities and situations.

Various embodiments of the present disclosure (e.g., any of the apparatuses 100, 400, 500, 600, etc.) can be used to increase physical fitness and athletic performance for people of all ages. In addition, various embodiments (e.g., any of the apparatuses 100, 400, 500, 600, etc.) can be used for rehabilitation from injury, surgery, any muscular or neuromuscular condition (e.g., stroke, Parkinson's disease, scoliosis, multiple sclerosis (MS), etc.). Furthermore, various embodiments (e.g., any of the apparatuses 100, 400, 500, 600, etc.) can be used at hospital beds to help people breathe more fully. Various embodiments (e.g., any of the apparatuses 100, 400, 500, 600, etc.) can be used for pulmonary rehabilitation for COVID-19, asthma, chronic obstructive pulmonary disease (COPD), etc.

An additional use case for various embodiments of the present disclosure (e.g., any of the apparatuses 100, 400, 500, 600, etc.) is to install it on a folding device such as, but not limited to, a walker, table, or chair. Various embodiments (e.g., any of the apparatuses 100, 400, 500, 600, etc.) can be attached to, but not limited to, the legs of the walker, table, or chair. For example, a user can pull the legs apart and lock them into place creating a stable structure utilizing the extension spring. To fold or close the walker, table, or chair, a user can release the extension spring by pulling apart the legs of the walker. To securely fold the walker, table, or chair, a user may press the legs together utilizing the compression spring and release, locking them into place. Further a user may release the compression spring to begin the unfolding process. The goal of this use case embodiment is to increase the usability and portability of walkers, tables, and chairs (and other furniture), especially for elderly, disabled, and those recovering from illness or injury.

In various embodiments, any of the springs of any of the apparatuses (e.g., 100, 400, 500, 600, etc.) described herein can be selected based on one or more of the following, but not limited to, its pounds per square inch, length, movement, dimensions, range of motion, and the like.

In various embodiments, any of the springs of any of the apparatuses (e.g., 100, 400, 500, 600, etc.) described herein can be implemented with one or more materials between the coils of the springs so that it would keep its compressive quality but restrict the spring from bowing or flexing out of line.

In various embodiments, any of the inner tubes (or cylinders) of any of the apparatuses (e.g., 100, 400, 500, 600, etc.) described herein can be implemented with a desired amount of flex that runs substantially parallel to the direction of the extension spring(s). In addition, the inner tubes can each be implemented with a combination of a portion of it being rigid while another portion of it has a desired amount of flex that runs substantially parallel to the direction of the extension spring(s). There is a variety of things that can be done to implement or fabricate the inner tubes to provide the desired range of motion and/or pounds per square inch for the extension spring(s) and compression spring(s).

In various embodiments, any of the handles (or loops) and pads of any of the apparatuses (e.g., 100, 400, 500, 600, etc.) described herein can be implemented such that each handle incorporates a pad instead of being separate components.

In various embodiments, any of the apparatuses (e.g., 100, 400, 500, 600, etc.) described herein including a median (or that could be modified to include a median), the apparatus could be implemented to have the ability to be unscrewed (or disconnected or separated) at the median creating two apparatuses (or sub-apparatuses) each with the ability to pull with resistance and push with resistance. In addition, one side of the median of the apparatus could be implemented with a stronger or weaker (e.g., more or less resistance) compression spring than the other compression spring on the other side of the median. Also, one side of the median of the apparatus could be implemented with a stronger or weaker (e.g., more or less resistance) extension spring than the other extension spring on the other side of the median of the apparatus. Moreover, there could be a variety of combinations of compression spring and extension spring resistances on each side of the median of the apparatus. In this manner, the apparatus can be implemented so that it includes non-symmetrical spring resistances on opposing sides of the median. One reason to do that is for a person that is rehabbing. Note that any of the apparatuses (e.g., 100, 400, 500, 600, etc.) described herein can be implemented so that a person has the ability to change out the springs of the apparatus or have the ability to modify it. Moreover, it is noted that any of the apparatuses (e.g., 100, 400, 500, 600, etc.) described herein can be implemented so that the resistances of the springs are non-symmetrical on opposing sides of the center of the apparatus.

In various embodiments, any of the housings of any of the apparatuses (e.g., 100, 400, 500, 600, etc.) described herein can be implemented to be separated or dismantled so that a person or user can switch out the springs for, but not limited to, a light resistance spring, a medium resistance spring, and a heavy resistance spring for each of the compression springs and extension springs of the apparatus. The housing and the entire apparatus can be implemented to be disassembled and assembled (e.g., by a person, a user, etc.). In addition, the housing could be implemented so that it can be opened up (e.g., with one or more hinges) and closed so that elements of the apparatus such as springs could be switched in and out.

In various embodiments, any of the apparatuses (e.g., 100, 400, 500, 600, etc.) as may be appropriate can be implemented so that the compression spring(s) can be located within an interior space of the extension spring(s).

In various embodiments, any of the apparatuses (e.g., 100, 400, 500, 600, etc.) as may be appropriate can be implemented so that the one or more compression springs can be incorporated with a flexible material that would function as a housing for the apparatus. In various embodiments, in a two compression spring apparatus with a median, each compression spring can be incorporated with a flexible material that would function as a housing along with the median that each compression spring can be connected or attached or coupled to. The material can be located in between the coils of the compression springs, or in between and incorporated around the compression springs. The flexible material in combination with the compression springs would have, but not limited to, the resistance (e.g., pounds per square inch), recoil, movement, and length that is desired for the apparatus. The flexible material can include, but is not limited to, a fabric, a plastic, a canvas, a metal, a rubber, a nylon, etc. and any combination thereof. The flexible material can be implemented to also include a desired rigidity so that the housing does not substantially distort or bow out or flex out of line in an undesirable manner. The housing can be molded to or around the compression spring (s) or the extension spring(s). The housing can be a spring-like tube made from material(s) that has the desire quality that it keeps its form around the axis that are substantially parallel with the movements of the springs, has variable resistance, and recoil.

In various embodiments, any of the springs of any of the apparatuses (e.g., 100, 400, 500, 600, etc.) described herein can be implemented with any type of metal or any combination of metals, any type of plastic or any combination of plastics, any type of nylon or any combination of nylon, and the like. Any of the springs can be made of any type of material or combination of materials that provide the desirable variable resistance and recoil for the desired functionalities of the apparatus.

In various embodiments, any of the inner tubes (or inner cylinders) of any of the apparatuses (e.g., 100, 400, 500, 600, etc.) as may be appropriate can be implemented to be rigid enough to provide a compressive force to the compression spring(s).

In various embodiments, note that any of the compression springs described herein can be implemented with a compression spring-like material or element and any of the extension springs described herein can be implemented with an extension spring-like material or element. In various embodiments, any compression spring described herein can provide resistance in a pushing motion while any extension spring described herein can provide resistance in a pulling motion.

It is noted that any mention of "attach to" herein can be substituted with "coupled with" and vice versa in accordance with various embodiments of the present disclosure.

The foregoing descriptions of various specific embodiments in accordance with the present disclosure have been presented for purposes of illustration and description. They are not intended to be exhaustive or to limit the present disclosure to the precise forms disclosed, and many modifications and variations are possible in light of the above teaching. The present disclosure is to be construed according to the Claims and their equivalents.

What is claimed is:

1. An apparatus for exercising comprising:

a housing;

a first inner tube;

a second inner tube;

a compression spring operable to resist motion when compressed, wherein the first inner tube is coupled with a first end of the compression spring and the second inner tube is coupled with a second end of the compression spring; and an extension spring inside the housing, wherein a portion of the compression spring and a portion of each of the first and second inner tubes are inside the housing, wherein a first end of the extension spring is coupled with a first handle or loop and the second end of the extension spring is coupled with a second handle or loop, wherein the extension spring operable to provide resistance during pulling motion away from a center of the apparatus.

2. The apparatus of claim 1, wherein the compression spring is operable to provide resistance during pushing motion toward center of the apparatus.

3. The apparatus of claim 1, wherein the extension spring is operable to provide recoil toward the center of the apparatus after release of the pulling motion.

4. The apparatus of claim 2, wherein the compression spring is operable to provide recoil away from the center of the apparatus after release of the pushing motion.

5. The apparatus of claim 1, wherein the apparatus comprises two different kinds of resistance to both pulling and pushing motions of a human body in a substantially similar movement plane.

6. The apparatus of claim 1, wherein the apparatus is portable.

7. The apparatus of claim 1, wherein the compression spring is operable to be replaced with a second compression spring.

8. The apparatus of claim 1, wherein the extension spring is operable to be replaced with a second extension spring.

9. The apparatus of claim 1, wherein the extension spring is located within an interior space of the compression spring.

* * * * *